US006595817B1

(12) United States Patent
Chang

(10) Patent No.: US 6,595,817 B1
(45) Date of Patent: Jul. 22, 2003

(54) SURFBOARD

(76) Inventor: Kung-Chao Chang, No. 17, Fu-Tien 1 St., Taichung (TW)

( * ) Notice: Subject to any disclaimer, the term of this patent is extended or adjusted under 35 U.S.C. 154(b) by 0 days.

(21) Appl. No.: 10/172,896

(22) Filed: Jun. 17, 2002

(51) Int. Cl.[7] ..... B63B 1/00
(52) U.S. Cl. ..... 441/79; 441/74
(58) Field of Search ..... 441/74, 79; 114/127, 114/138, 139, 140, 141; 403/321, 324

(56) References Cited

U.S. PATENT DOCUMENTS 5,133,681 A * 7/1992 Lobe ..... 441/79
5,176,096 A * 1/1993 Molnar et al. ..... 114/127
5,176,553 A * 1/1993 Tuttle ..... 441/79
5,464,359 A * 11/1995 Whitty ..... 441/79
5,493,989 A * 2/1996 Anderson ..... 114/138
5,597,337 A * 1/1997 Nedderman, Jr. ..... 441/79
5,997,376 A * 12/1999 Block et al. ..... 441/79
6,068,531 A * 5/2000 Patterson ..... 441/74
6,247,985 B1 * 6/2001 Block et al. ..... 441/79
6,386,933 B1 * 5/2002 Rewald et al. ..... 441/74
6,439,940 B1 * 8/2002 Pouchkarev ..... 441/79

* cited by examiner

*Primary Examiner*—S. Joseph Morano
*Assistant Examiner*—Ajay Vasudeva
(74) *Attorney, Agent, or Firm*—Alan D. Kamrath; Rider Bennett, LLP.

(57) ABSTRACT

A surfboard includes board, a fin connector securely mounted in the board and a fin attached to the fin connector. The surfboard has two setscrews screwed into the fin connector to hold the fin in place and a bolt extending through the fin connector, which screws into the fin to strengthen the connection between the fin connector and the fin.

3 Claims, 5 Drawing Sheets

SURFBOARD

BACKGROUND OF THE INVENTION

1. Field of the Invention

The present invention relates to a surfboard, and more particularly to a surfboard with a connector to mount a fin on the surfboard.

2. Description of Related Art

With reference to FIGS. 4 and 5, a conventional surfboard in accordance with the prior art comprises board (50) and a fin (54). The board (50) has a front end, a rear end, a top surface, a bottom surface and a longitudinal axis from the front end to the rear end. The fin (54) has a broad base and a distal tip and is mounted perpendicular to the bottom surface of the board (50) near the rear end of the board (50).

The board (50) has a rectangular block (51) longitudinally mounted in the board (50) near the rear end of the board (50) and flush with the bottom of the board (50). The rectangular block (51) has a front end, a rear end and two parallel sides. A mortise (52) is defined longitudinally in each end of the rectangular block (51) and is aligned with the longitudinal axis of the board (50). Two threaded holes (53) are defined in the rectangular block (51). The two threaded holes (53) are defined in opposite sides, and each obliquely communicates with one of the mortises (52) in the rectangular block (51).

The fin (54) has two tenons (55) extending from base of the fin (54), which correspond to and are mounted in the two mortises (52) in the rectangular block (51). A recess (56) is defined in each tenon (55) to correspond the two threaded hole (53) that communicates with the mortise (52). The surfboard further comprises two setscrews (57) screwed into the threaded holes (53) and abutting the recesses (56) in the tenons (55) of the fin (54) to hold the fin (54) in place on the bottom of the board (50).

The conventional surfboard in accordance with the prior art has the following disadvantages.

1. The conventional surfboard only has two setscrews (57) to hold the fin (54) in place. Consequently, the fin (54) easily detaches from the board (50) after being subjected to the shocks and vibration of extended use.

2. The fin (54) has two tenons (55) inserted into the rectangular block in the board (50) so that the resistive force from the water is carried by the two tenons (55). Consequently, the two tenons (55) easily break because they are relatively small compared to the base of the fin (54).

The present invention has arisen to mitigate and/or obviate the disadvantages of the conventional surfboard.

SUMMARY OF THE INVENTION

The main objective of the present invention is to provide a surfboard with an improved fin and fin connection.

To achieve the objective, the surfboard in accordance with the present invention comprises a board, a fin connector and a fin. The fin connector is mounted in the board, and the fin is attached to the fin connector. The surfboard has two setscrews to hold the fin in place, and a bolt extends through the board into the fin connector and is screwed into the fin to strengthen the connection between the fin connector and the fin.

Further benefits and advantages of the present invention will become apparent after a careful reading of the detailed description with appropriate reference to the accompanying drawings.

DETAILED DESCRIPTION OF THE INVENTION

Figure 1:
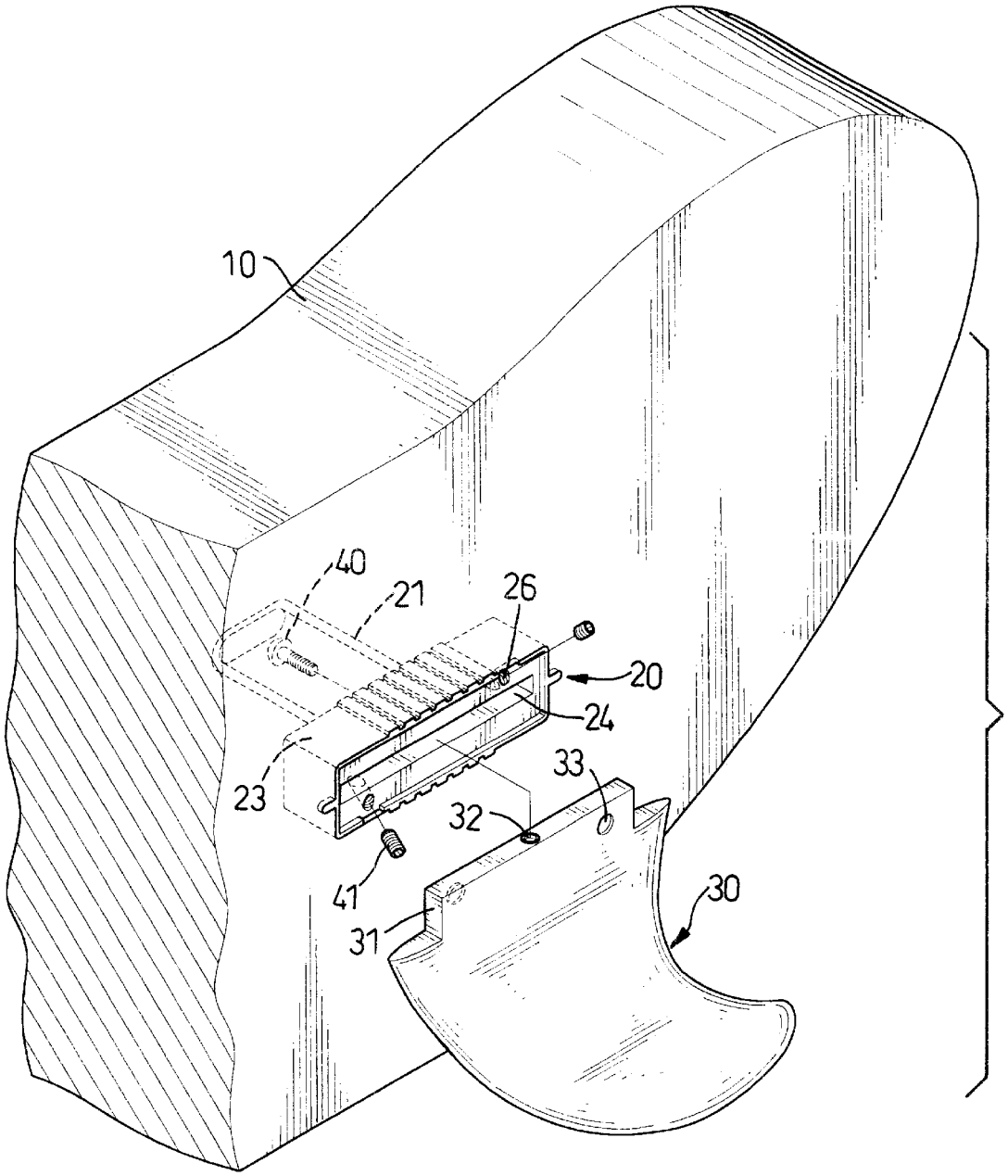
FIG. 1 is an exploded perspective view of a surfboard in accordance with the present invention.
Figure 2:
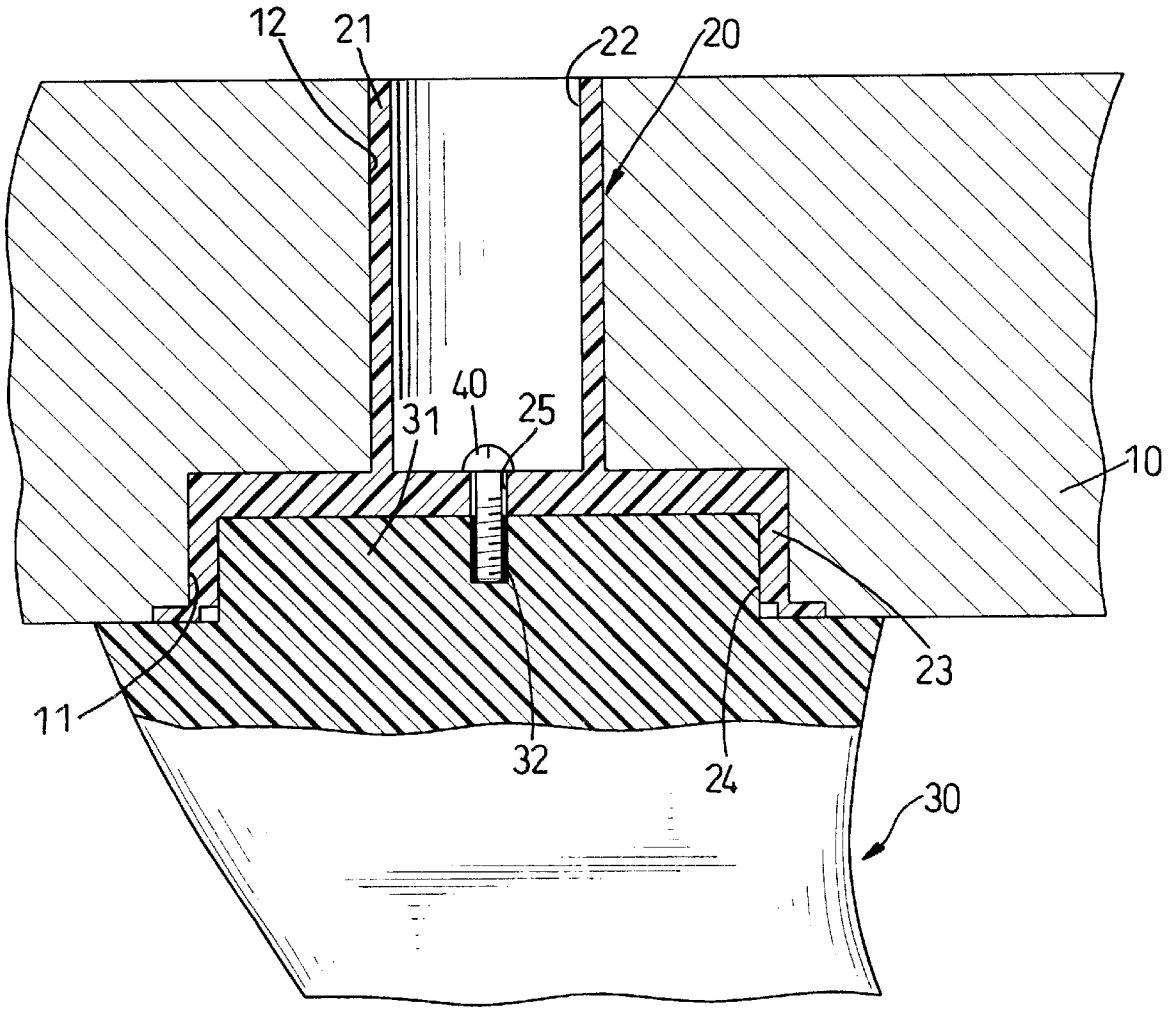
FIG. 2 is an enlarged side plan view in partial section of the surfboard in FIG. 1.
Figure 3:
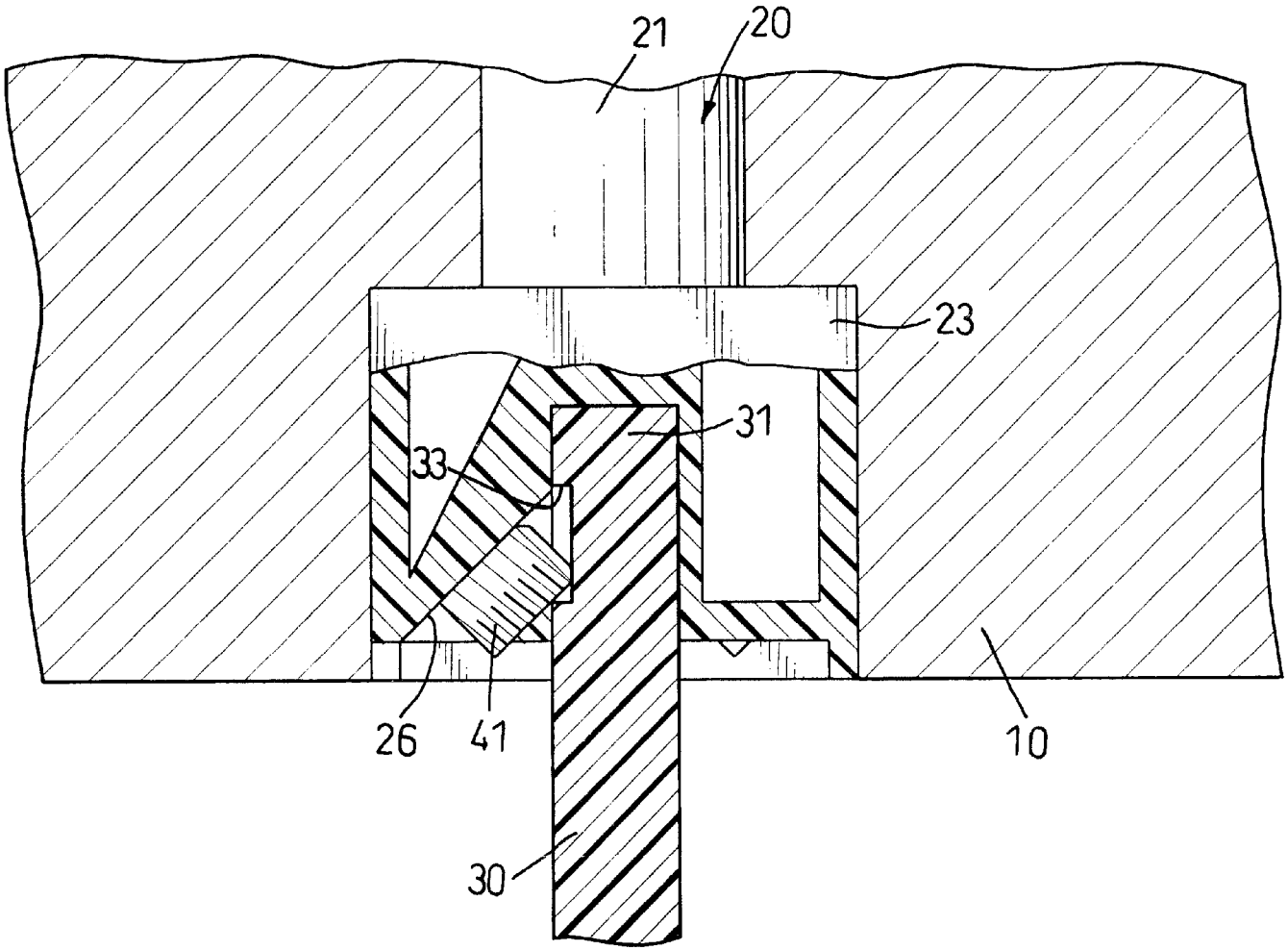
FIG. 3 is a cross sectional front plan view of the surfboard in FIG. 1.
Figure 4:
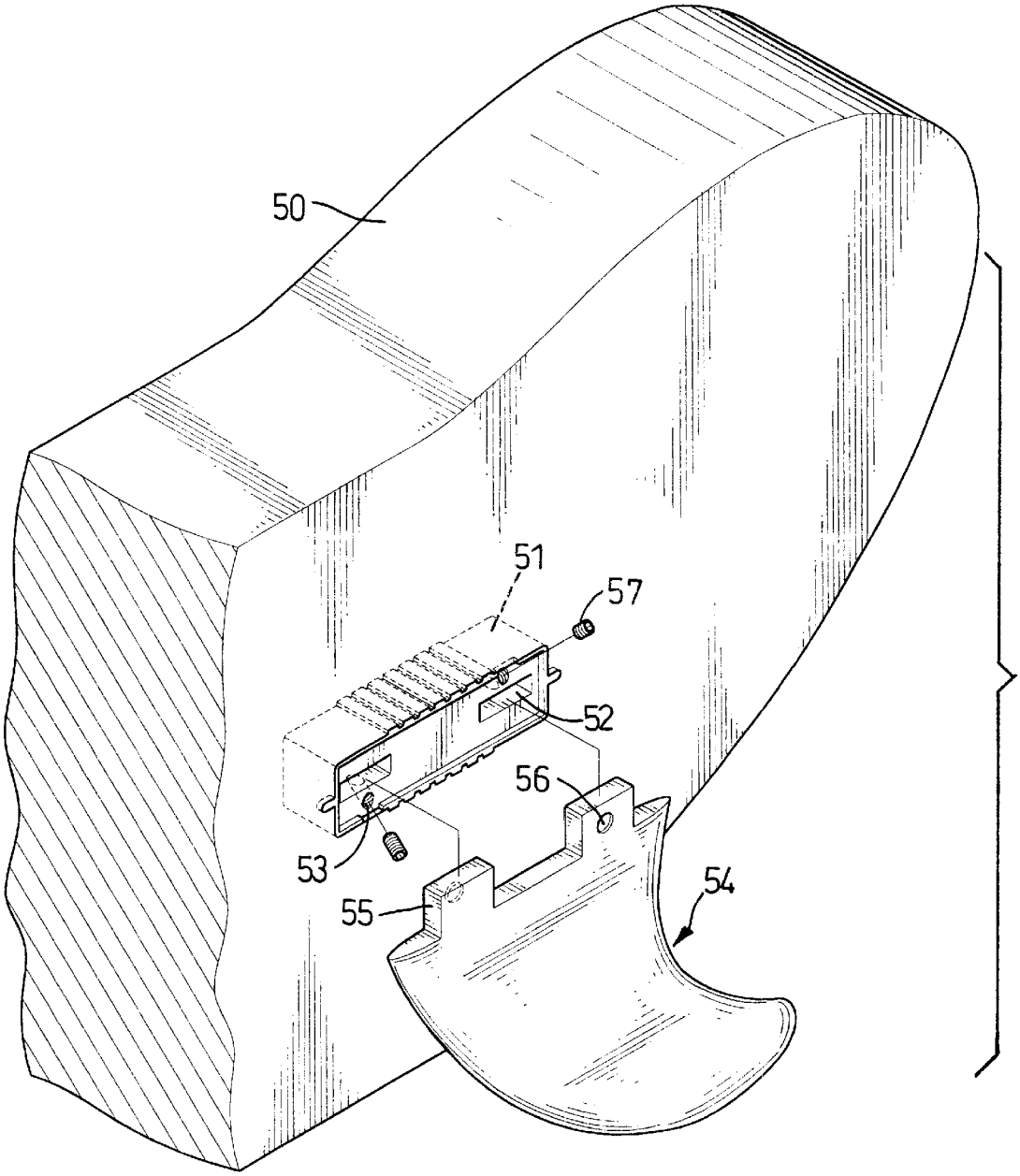
FIG. 4 PRIOR ART
FIG. 4 is an exploded perspective view of a conventional surfboard in accordance with the prior art.
Figure 5:
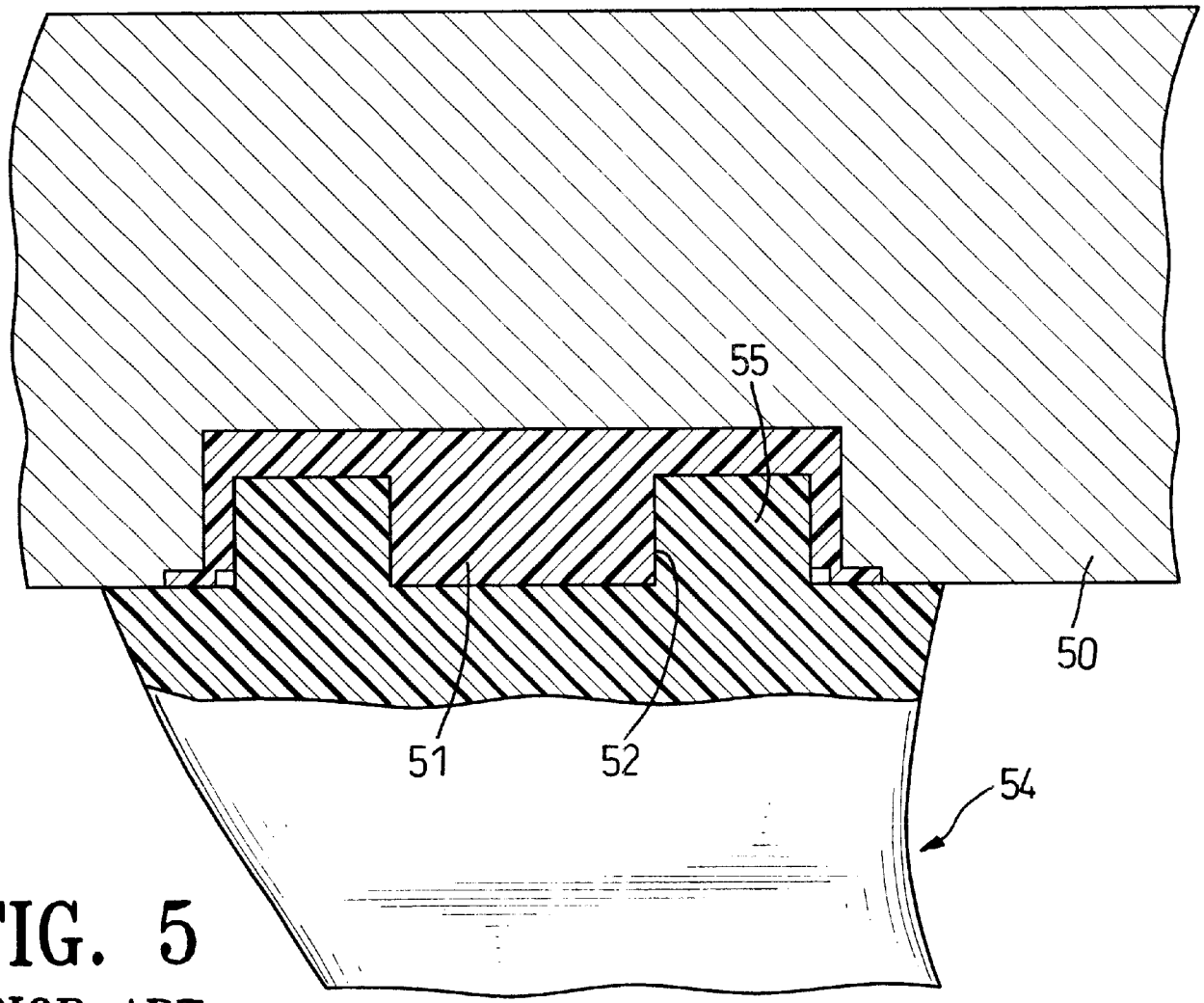
FIG. 5 PRIOR ART
FIG. 5 is a side plan view in partial section of the surfboard in FIG. 4.

With reference to the drawings and initially to FIGS. 1, 2 and 3, a surfboard in accordance with the present invention comprises a board (10), a fin connector (20) and a fin (30). The fin connector (20) is mounted securely in the board (10). The fin (30) is attached to the fin connector (20).

The board (10) has a front and rear end (not shown), a top surface (not numbered) and a bottom surface (not numbered) and includes a recess (1) defined in the bottom surface near the rear end of the board (10). In the preferred embodiment of the present invention, the recess (11) is cuboidal. A hole (12) is perpendicularly defined through the top surface of the board (10) and communicates with the recess (11) in the bottom of the board (10).

The fin connector (20) includes a rectangular block (23) and a stub (21). The rectangular block (23) is securely mounted in the recess (11) in the board (10). The stub (21) extends perpendicular from the rectangular block (23) and has a top end. The stub (21) is securely mounted in the hole (12) in the board (10) and has a passage (22) axially defined in the stub (21). The top end of the stub (21) is flush with top surface of the board (10). The rectangular block (23) has mortise (24) longitudinally defined in the rectangular block (23). The mortise (24) has a flat bottom (not numbered). A through hole (25) is defined in a bottom of the mortise (24) and communicates with the passage (22) in the stub (21). The rectangular block (23) has a front end, a rear end, two sides, a face and a bottom side. A threaded hole (26) is defined near the front and rear ends of the face on a bias to communicate with the mortise (24). The two threaded holes (26) are defined on opposite sides of the mortise (24) from each other.

The fin (30) has a long longitudinal base (not numbered) and tapers to a blunt tip (not numbered). A longitudinal tenon (31) with an end (not numbered) and two long sides (not numbered) is formed on and extends from the base of the fin (30). The tenon (31) is mounted in the mortise (24) in the rectangular block (23). A threaded hole (32) corresponding to the through hole (25) in the rectangular block (23) is defined in the end of the tenon (31). Two recesses (33) corresponding to the two threaded holes (26) in the rectangular block (23) are defined in the sides of the tenon (31).

The surfboard further comprises two setscrews (41) each screwed through one of the threaded holes (26) in the rectangular block (23) and abut the corresponding recess (33) in the mortise (31) to hold the fin (30) in place. A bolt (40) extends through the through hole (25) between the stub (21) and the mortise (24) and is screwed into the threaded hole (32) in the fin (30) to strengthen the connection between the rectangular block (23) and the fin (30).

The surfboard in accordance with the present invention has the following advantages.

1. The surfboard of the present invention has two setscrews (41) and a bolt (40) to hold the fin (54) in place. Consequently, the fin (54) will not easily detach from the board (50) when the surfboard is in use.

2. The tenon (31) on the fin (30) of the present invention is longer than the tenons (55) of the fin (30) on the conventional surfboard. Consequently, the tenon (31) of the present invention is stronger and less likely to break.

Although the invention has been explained in relation to its preferred embodiment, it is to be understood that many other possible modifications and variations can be made without departing from the spirit and scope of the invention as hereinafter claimed.

What is claimed is:

1. A surfboard comprising:

a board with a front and rear end, a top surface and a bottom surface including:

a recess defined in the bottom surface near the rear end of the board; and a hole perpendicularly defined through the top surface of the board, which communicates with the recess in the bottom of the board;

a fin connector securely mounted in the board and including:

a rectangular block securely mounted in the recess in bottom of the board and a stub extending perpendicular from the rectangular block, where the stub has a top end is securely mounted in the hole in the board and a passage is axially defined in the stub;

the rectangular block has:

a front end, a rear end, two sides, a face and a bottom side;

a mortise with a bottom longitudinally defined in the rectangular block;

a through hole defined in the bottom of the mortise and communicates with the passage in the stub; and a threaded hole is defined near the front and rear ends of the face on a bias to communicate with the mortise, and the threaded holes are defined on opposite sides of the mortise from each other;

a fin with a long longitudinal base attached to the fin connector and having a longitudinal tenon with an end and two long sides extending from base of the fin and mounted in the mortise in the rectangular block, a threaded hole corresponding to the through hole in the rectangular block and defined in the end of the tenon and two recesses defined in the sides of the tenon and corresponding to the two threaded holes in the rectangular block;

two setscrews, each screwed through one of the threaded holes in the rectangular block and abut the corresponding recess in the mortise to hold the fin in place; and a bolt extending through the through hole in the rectangular block and screwed into the threaded hole in the fin to strengthen the connection between the rectangular block and the fin.

2. The surfboard as claimed in claim 1, wherein the recess is cuboidal.

3. The surfboard as claimed in claim 1, wherein the top end of the stub is flush with top surface of the board.

* * * * *